US010188904B2

(12) United States Patent
Tam et al.

(10) Patent No.: US 10,188,904 B2
(45) Date of Patent: Jan. 29, 2019

(54) SWITCHABLE INTELLIGENT FITNESS HANDLE AND INTELLIGENT FITNESS SET INCLUDING THE SAME

(71) Applicant: EGGPLANT TECHNOLOGIES, Guangzhou, Guangdong (CN)

(72) Inventors: Ka Lun Alan Tam, Guangdong (CN); Feng Liu, Guangdong (CN); Ivan Ho, Guangdong (CN); Oscar Wong, Guangdong (CN); Jinru Zhou, Guangdong (CN)

(73) Assignee: EGGPLANT TECHNOLOGIES, Guangzhou (CN)

( * ) Notice: Subject to any disclaimer, the term of this patent is extended or adjusted under 35 U.S.C. 154(b) by 0 days.

(21) Appl. No.: 16/104,345

(22) Filed: Aug. 17, 2018

(65) Prior Publication Data

US 2018/0353811 A1 Dec. 13, 2018

Related U.S. Application Data

(63) Continuation of application No. PCT/CN2016/078636, filed on Apr. 7, 2016.

(30) Foreign Application Priority Data

Feb. 19, 2016 (CN) ..... 2016 2 0131739 U

(51) Int. Cl.
*A63B 5/20* (2006.01)
*A63B 21/00* (2006.01)
(Continued)

(52) U.S. Cl.
CPC ..... *A63B 24/0062* (2013.01); *A63B 5/20* (2013.01); *A63B 21/0552* (2013.01);
(Continued)

(58) Field of Classification Search
None
See application file for complete search history.

(56) References Cited

U.S. PATENT DOCUMENTS 5,620,397 A 4/1997 Chieh
6,539,336 B1 * 3/2003 Vock ..... A42B 3/0433 702/178

(Continued)

FOREIGN PATENT DOCUMENTS

CN 101342411 A 1/2009
CN 202637907 U 1/2013
CN 103520876 A 1/2014

*Primary Examiner* — Sundhara M Ganesan
(74) *Attorney, Agent, or Firm* — Wayne & Ken, LLC; Tony Hom

(57) ABSTRACT

A switchable intelligent fitness handle is disclosed. A processor (11), a movement posture sensor (12) and a touch sensor (13) are built in the handle (7). The movement posture sensor (12) and the touch sensor (13) are connected to the processor (11). Each handheld fitness equipment has a corresponding sensor, and a pin connector (16, 17, 18, 19) that is matched with the bayonet (15) of the handle and provided with a signal line. Thus, the goal of accomplishing a set of exercises with a plurality of handheld fitness equipments by using one same set of handles can be achieved. An intelligent fitness set containing the fitness handle is further disclosed.

10 Claims, 12 Drawing Sheets

(51) Int. Cl.
*A63B 22/20* (2006.01)
*A63B 24/00* (2006.01)
*A63B 21/055* (2006.01)

(52) U.S. Cl.
CPC ..... *A63B 21/4035* (2015.10); *A63B 22/203* (2013.01); *A63B 2024/0065* (2013.01); *A63B 2220/20* (2013.01); *A63B 2220/51* (2013.01); *A63B 2220/56* (2013.01); *A63B 2220/803* (2013.01); *A63B 2220/805* (2013.01); *A63B 2220/833* (2013.01); *A63B 2230/06* (2013.01); *A63B 2230/62* (2013.01)

(56) References Cited

U.S. PATENT DOCUMENTS 7,789,742 B1 * 9/2010 Murdock ..... A63B 24/0021 463/3
9,713,743 B1 * 7/2017 Friedlander ..... A63B 24/0062
2007/0232455 A1 * 10/2007 Hanoun ..... A63B 4/0006 482/8
2011/0070569 A1 3/2011 Martens
2012/0041767 A1 * 2/2012 Hoffman ..... A63B 24/0059 705/1.1
2012/0214646 A1 * 8/2012 Lull ..... G01L 3/242 482/5
2013/0165246 A1 * 6/2013 Jeffery ..... A63B 69/36 473/223
2013/0281261 A1 * 10/2013 Gatherer ..... A63B 24/0006 482/8
2015/0157896 A1 * 6/2015 Soerensen ..... A63B 71/0622 482/8
2016/0101320 A1 * 4/2016 Tsutsui ..... A63B 21/0722 482/8
2017/0106240 A1 * 4/2017 Chuang ..... A63B 21/0726
2017/0209743 A1 * 7/2017 Bengtsson ..... A63B 24/0062

* cited by examiner

SWITCHABLE INTELLIGENT FITNESS HANDLE AND INTELLIGENT FITNESS SET INCLUDING THE SAME

CROSS-REFERENCE TO RELATED APPLICATIONS

This application is a continuation of International Application No. PCT/CN2016/078636 with a filing date of Apr. 7, 2016, designating the United States, now pending, and further claims to Chinese application no. 201620131739.0 with a filing date of Feb. 19, 2016. The content of the aforementioned applications, including any intervening amendments thereto, are incorporated herein by reference.

TECHNICAL FIELD

The present disclosure relates to an intelligent fitness handle, and more particularly to a switchable intelligent fitness handle and intelligent fitness set including the handle.

BACKGROUND

Generally, most existing fitness equipments are just used independently. Even though an intelligent equipment is provided for use together with a mobile phone, it may just be allowed that one mobile phone is connected with one fitness equipment to achieve the function of intelligent counting and the like. When a user needs to use several different fitness equipments in a training course, the user is required to connect the mobile phone to different equipments when changing equipments, so that the fitness data from different equipments can be collected. As a result, the user may spend too much time connecting the mobile phone with the intelligent fitness equipments, leading to bad fitness experience. To achieve intelligent fitness, different fitness equipments need to be bought. In addition, information from different fitness equipments, such as movement counts, cannot be displayed in a mobile software, bringing inconvenience to the user too.

SUMMARY

Technical Problems

One object of the present disclosure is to overcome the above defects of the prior art by providing a switchable intelligent fitness handle. The handle is simple in structure, convenient to use, and can be connected to a plurality of fitness equipments by means of a switchable hot-pluggable bayonet to collect the movement information from the plurality of fitness equipments.

Another object of the present disclosure is to provide an intelligent fitness set.

Technical Solutions to the Problems

The object of the present invention can be achieved by adopting the following technical solutions.

A processor, a movement posture sensor and a touch sensor are built in the handle. The movement posture sensor and the touch sensor are connected to the processor. One end of the handle is closed and a switchable hot-pluggable bayonet is arranged at the other end to connect a plurality of handheld fitness equipments. A pin connector matched with the bayonet is arranged in each of the plurality of handheld fitness equipments. When the handle is connected to one of the plurality of handheld fitness equipments, the processor receives an equipment identification number transmitted by the handheld fitness equipment through the pin connector, collects movement information of the corresponding handheld fitness equipment based on the received equipment identification number, and uploads the movement information to a mobile terminal or a cloud server.

Preferably, an elastic button is arranged on the handle. After the handle is connected to one of the plurality of handheld fitness equipments, the handle will be locked by an elastic clamping piece arranged on the pin connector corresponding to the elastic button. And when the elastic button on the handle is pressed, the elastic clamping piece on the pin connector is pressed to move downwards, enabling the handle to depart from each of the plurality of handheld fitness equipments.

Preferably, a power supply is further built in the handle and the power supply is configured to power the processor, the movement posture sensor and the touch sensor.

Preferably, a photoelectric sensor is further built in the handle and the photoelectric sensor is connected to the processor.

Preferably, a heart rate sensor is further built in the handle and the heart rate sensor is connected to the processor.

Preferably, a distance measuring sensor is further built in the handle and the distance measuring sensor is connected to the processor.

Preferably, a pressure sensor is further built in the handle and the pressure sensor is connected to the processor.

Another object of the present invention can be achieved by adopting the following technical solutions.

An intelligent fitness set includes a support, a base, a plurality of handheld fitness equipments, and the handle described above. Preferably, two handles are provided. A sensor, and the pin connector matched with the bayonet of the handle are arranged in each of the plurality of handheld fitness equipments. A signal line is arranged in the pin connector and the plurality of handheld fitness equipments are detachably fixed on the support. The two handles are placed on the base and the support is fixedly connected to the base.

Preferably, the plurality of handheld fitness equipments includes a power roller equipment, a push-up equipment, a rope skipping equipment, and a U-shaped elastic rope equipment. A pressure sensor and an infrared ranging device are built in the handheld power roller equipment. The pin connector matched with the bayonet of each of the handle is arranged at each of two ends of the handheld power roller equipment. The pressure sensor, an infrared ranging device and an infrared line-crossing detection unit are built in the push-up equipment. The pin connector matched with the bayonet of the handle is arranged on a top of the push-up equipment. An infrared detector is built in the rope skipping equipment. The pin connector matched with the bayonet of the handle is arranged at two ends of the rope skipping equipment. A tension sensor is built in the elastic rope equipment. The pin connector matched with the bayonet of the handle is arranged at one end of a u-shaped opening of the elastic rope equipment and an opening is arranged at the other end of the u-shaped opening of the elastic rope equipment for the handle to pass through.

Preferably, a first hole is arranged in an upper portion of the support, and a second hole and a third hole are arranged in a lower portion of the support. One portion of the push-up equipment is detachably fixed on the upper portion of the support by inserting the pin connector into the first hole. The other portion is detachably fixed on the lower portion of the support by inserting the pin connector into the second hole. The power roller equipment is arranged between the two portions of the push-up equipment. Two ends of the power roller equipment are inserted into the centers of the two portions of the push-up equipment through the pin connector. The rope skipping equipment is inserted into the third hole. The elastic rope equipment is hung on the support, such that the two ends of the elastic rope equipment are positioned on two sides of the support.

Beneficial Effects of the Invention

The present disclosure has the following beneficial effects compared with the prior art.

The intelligent fitness handle of the present disclosure can be connected to a plurality of handheld fitness equipments by designing a switchable hot-pluggable bayonet, and each of the plurality of handheld fitness equipment has corresponding sensors and pin connectors matched with the bayonets of the handles. When the handle is connected with one of the handheld fitness equipment, the processor built in the handle receives the equipment identification number transmitted by the handheld fitness equipment via the corresponding pin connector, and collects movement information (such as a movement count, whether a movement action is correct, and the like) from the corresponding handheld fitness equipment according to the equipment identification number and then uploads the movement information to a mobile terminal or a cloud server. Thus, the movement information from a plurality of handheld fitness equipments is collected by using one same handle. As a result, the user's operations can be simplified.

The intelligent fitness set of the present disclosure includes two intelligent fitness handles and a plurality of handheld fitness equipments, preferably, four handheld fitness equipments, i.e., a power roller equipment, a push-up equipment, a rope skipping equipment, and an elastic rope equipment. Pin connectors are disposed on the power roller equipment, the push-up equipment, the rope skipping equipment and the elastic rope equipment, so that the handles can be inserted into the four handheld fitness equipments. With equipment identification numbers transmitted by the pin connectors, the handles can be switched to the movement modes of different handheld fitness equipments to collect action feedbacks from different equipments. Thus, a plurality of handheld fitness equipments can share one handle to achieve the goals of simple structure, low cost, and accomplishing a set of exercises with a plurality of handheld fitness equipments by using one same set of handles.

One support and one base are provided in the intelligent fitness set of the present disclosure. The preferred four handheld fitness equipments are detachably fixed on the support, while the two handles are placed on the base, and the support is fixedly connected to the base. The intelligent fitness set has a good-looking appearance, occupies small space, and is suitable for use in various places.

Figure 1:
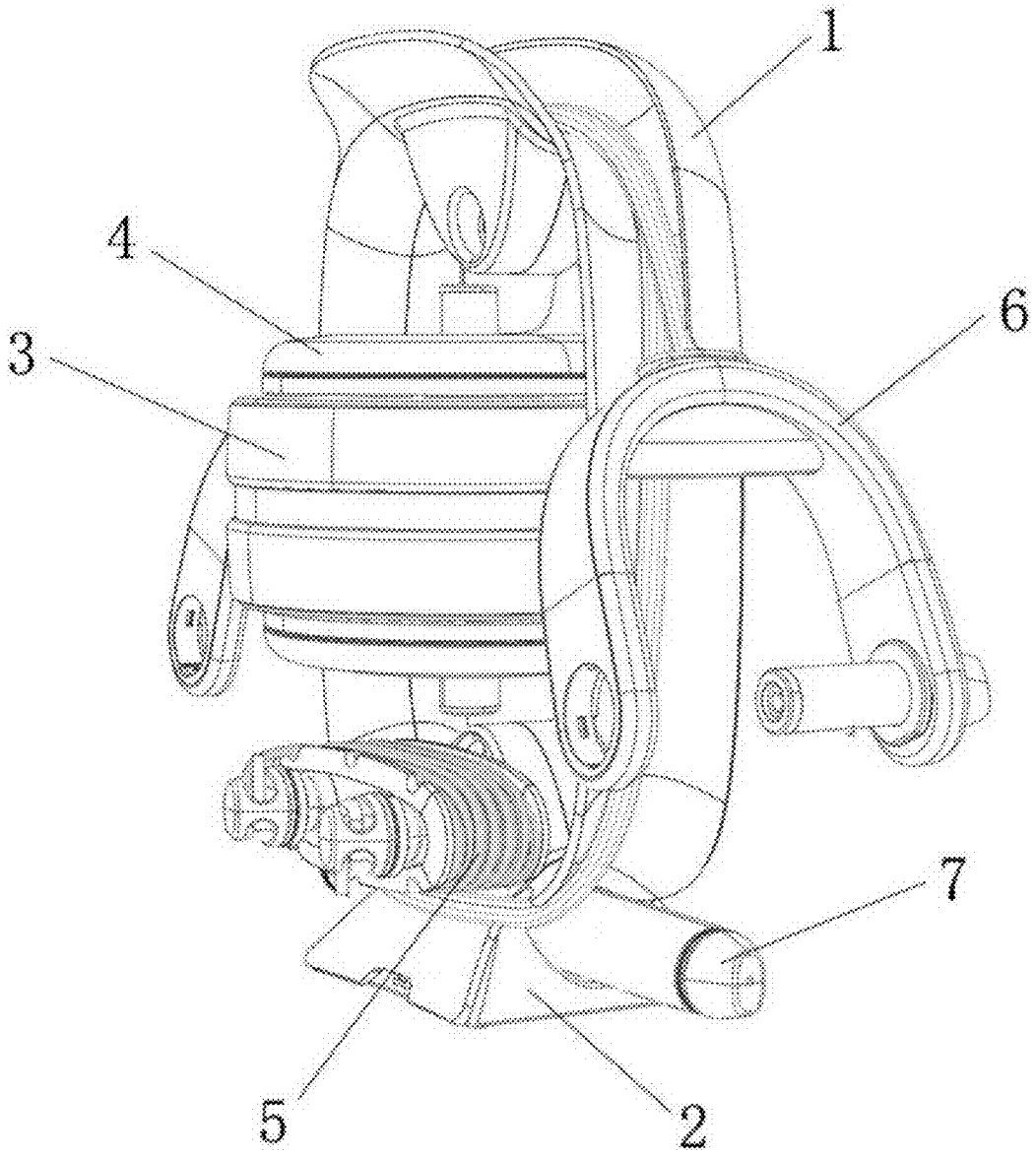
FIG. 1 is a structural diagram of intelligent fitness set according to an embodiment of the present disclosure.

In the drawings, reference numerals and components denoted thereby are as follows:

1. support; 2. base; 3. power roller equipment; 4. push-up equipment; 5. rope skipping equipment; 6. elastic rope equipment; 7. handle; 8. first hole; 9. second hole; 10. third hole; 11. processor; 12. movement posture sensor; 13. touch sensor; 14. power supply; 15. bayonet; 16. first pin connector; 17. second pin connector; 18. third pin connector; 19. fourth pin connector; 20. opening; 21. elastic button; 22. elastic clamping piece.

DETAILED DESCRIPTION OF ILLUSTRATED EMBODIMENTS

The present disclosure will be described below in further detail in conjunction with embodiments and the accompanying drawings to which, however, the implementations of the present disclosure are not limited.

Embodiment 1

Figure 2:
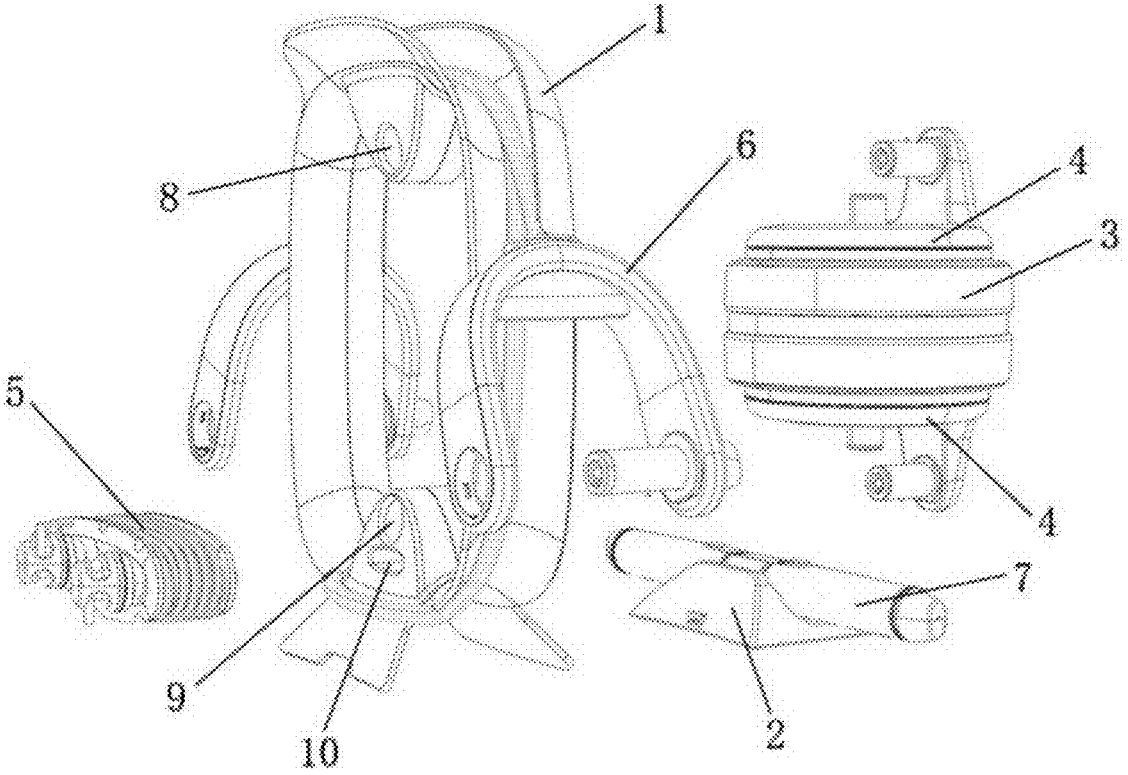
FIG. 2 is an exploded structural diagram of intelligent fitness set according to an embodiment of the present disclosure.

As shown in FIGS. 1 and 2, the intelligent fitness set of this embodiment includes a support 1, a base 2, a power roller equipment 3, a push-up equipment 4, a rope skipping equipment 5, an elastic rope equipment 6, and two handles 7. A first hole 8 is arranged in the upper portion of the support 1, while a second hole 9 and a third hole 10 are arranged in the lower portion of the support.

Figure 3:
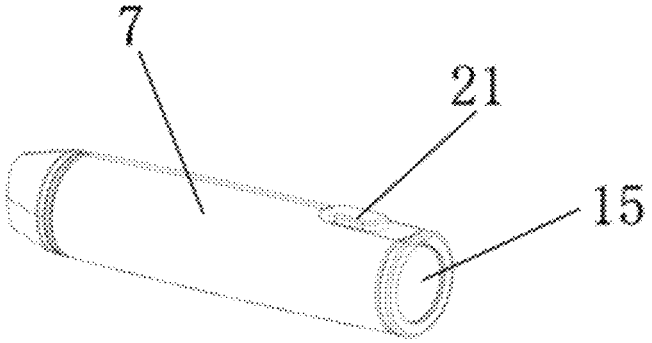
FIG. 3 is a structural diagram of a handle according to an embodiment of the present disclosure.
Figure 4:
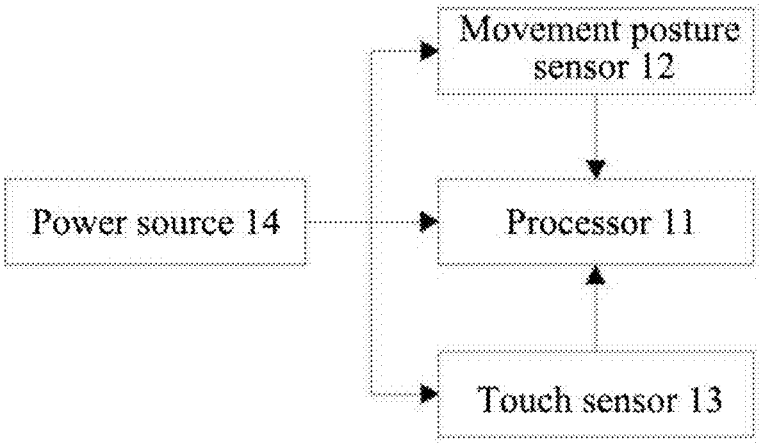
FIG. 4 is an inner schematic block diagram of a handle according to an embodiment of the present disclosure.

As shown in FIGS. 3 and 4, the handle 7 is a switchable intelligent fitness handle in which a processor 11, a movement posture sensor 12, a touch sensor 13 and a power supply 14 are built. The movement posture sensor 12 and the touch sensor 13 are connected to the processor 11, respectively. The processor 11 is an ARM processor and can be disposed on a circuit board. The movement posture sensor 12 is capable of detecting postures such as a direction and an angle of the elastic rope equipment 6. The touch sensor 13 is configured to detect a touch signal when the handle 7 is held by a user. The power supply 14 is a lithium ion battery for supplying power to the processor 11, the movement posture sensor 12 and the touch sensor 13. The handle 7 has one end closed and is provided, at the other end thereof, with a bayonet 15. The bayonet 15 is a switchable hot-pluggable bayonet to connect the power roller equipment 3, the push-up equipment 4, the rope skipping equipment 5 and the elastic rope equipment 6 separately.

One of the two handles 7 may be taken as a primary handle (right handle), and the other one may be taken as a secondary handle (left handle). A Radio Frequency (RF) antenna and a Bluetooth Low Energy (BLE) antenna may be built in the primary handle to allow the primary handle to communicate with a mobile terminal. An RF antenna may be built in the secondary handle to allow the secondary handle to communicate with a mobile terminal.

Figure 5:
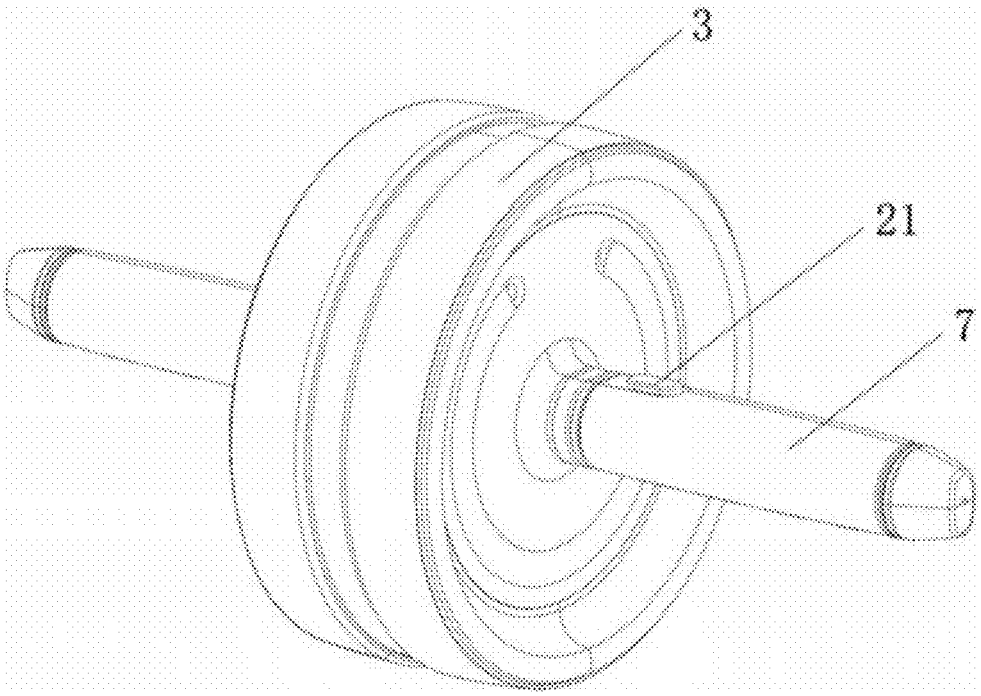
FIG. 5 is a schematic diagram of the handles after being connected with a power roller equipment according to an embodiment of the present disclosure.
Figure 6:
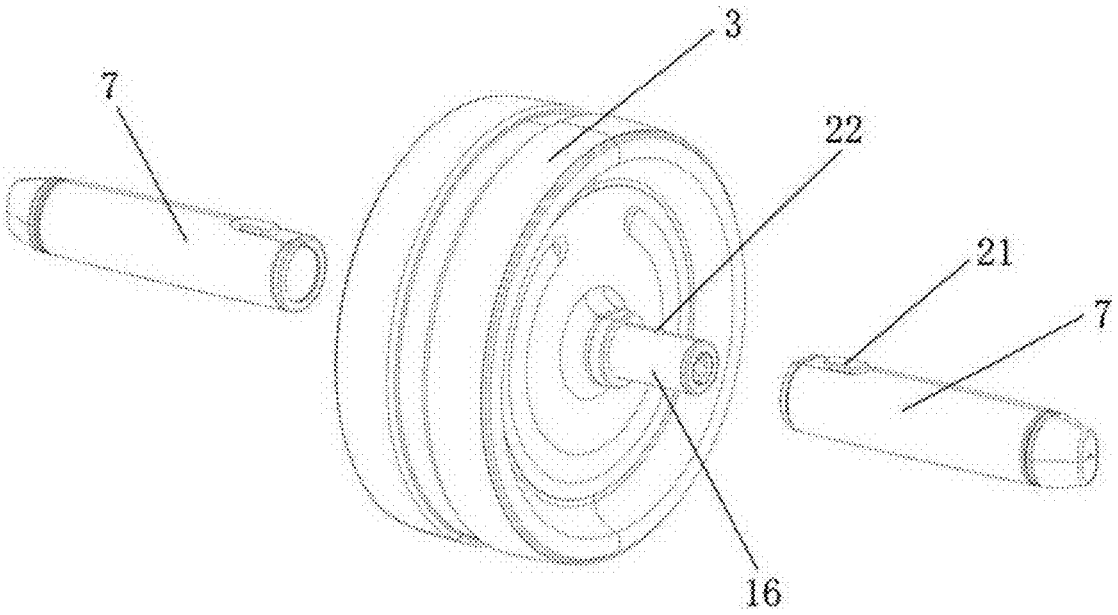
FIG. 6 is a schematic diagram of the handles after being withdrawn from the power roller equipment according to an embodiment of the present disclosure.

As shown in FIGS. 5 and 6, a pressure sensor and an infrared ranging device are built in the power roller equipment 3, and first pin connector matched with the bayonet 15 of the handle 7 is disposed at two ends of the power roller equipment 3, respectively. Each of the first pin connectors is provided with a signal line. The pressure sensor is configured to detect, when the power roller equipment 3 is used by a user, the weight of the user's body bearing on the power roller equipment 3. The infrared ranging device is configured to detect the number of turns of rolling of the power roller equipment 3 and convert it into a specific distance. When the first pin connector 16 is inserted into the bayonet 15 of the handle 7, the pressure sensor and the infrared ranging device can transmit the detected data to the processor 11 by means of the signal lines of the first pin connector 16.

Figure 7:
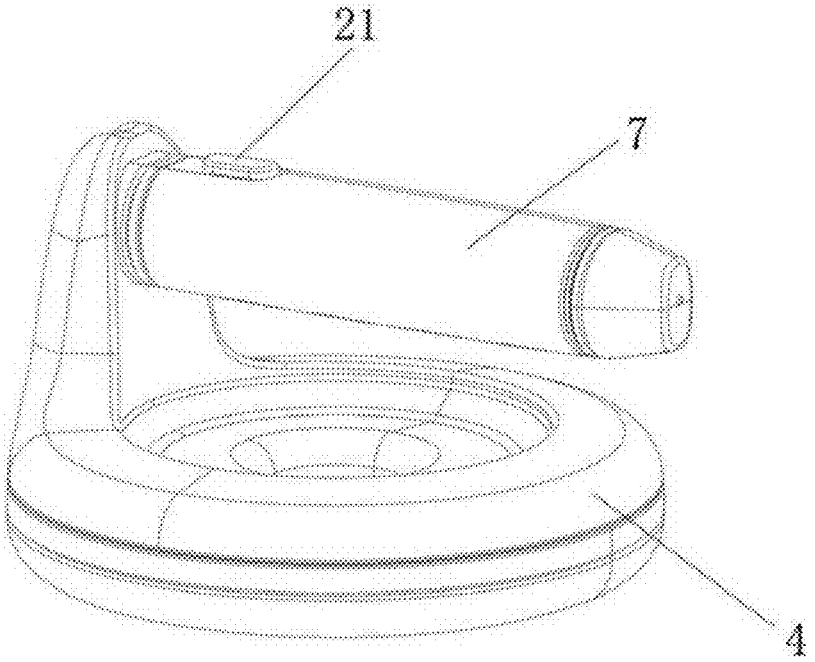
FIG. 7 is a schematic diagram of a handle after being connected with a portion of a push-up equipment according to an embodiment of the present disclosure.
Figure 8:
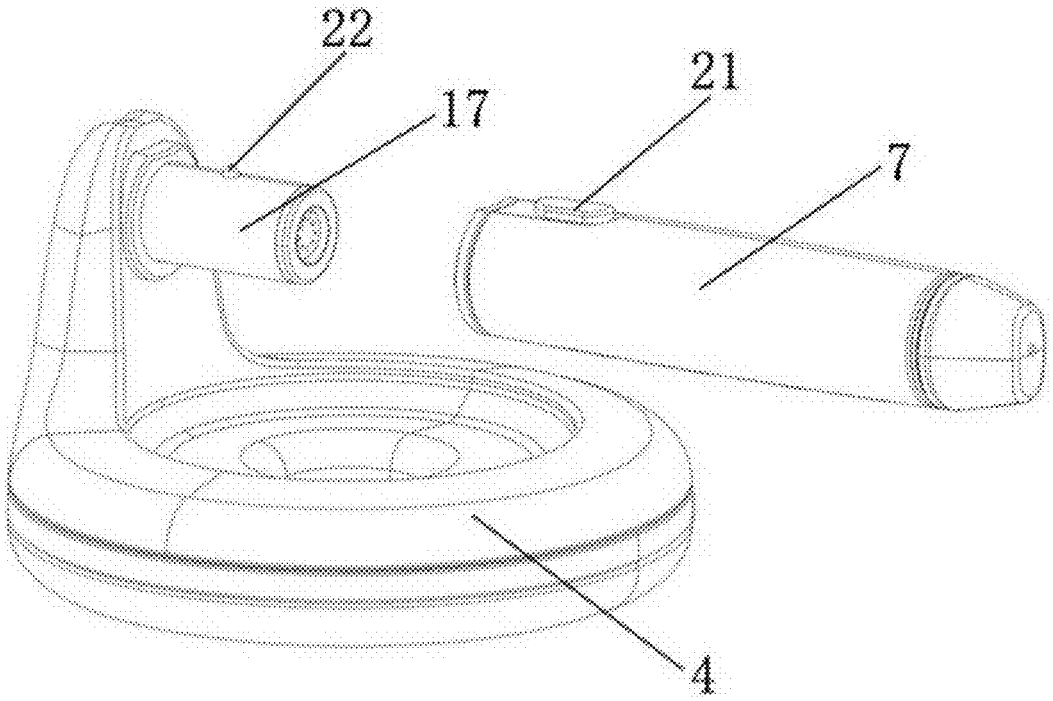
FIG. 8 is a schematic diagram of the handle after being withdrawn from the portion of the push-up equipment according to an embodiment of the present disclosure.

As shown in FIGS. 7 and 8, a pressure sensor, an infrared ranging device and an infrared line-crossing detection unit are built in the push-up equipment. In addition, the push-up equipment is divided into two portions (only one portion is shown in the figures), and a second pin connector 17 matched with the bayonet 15 of the handle 7 and provided with a signal line is disposed on the top of each portion. The pressure sensor is configured to detect the pressure of the user's hands on the push-up equipment 4. When the second pin connector 17 is inserted into the bayonet 15 of the handle 7, the pressure sensor, the infrared ranging device and the infrared line-crossing detection unit can transmit the detected data to the processor 11 by means of the signal lines of the second pin connector 17.

Figure 9:
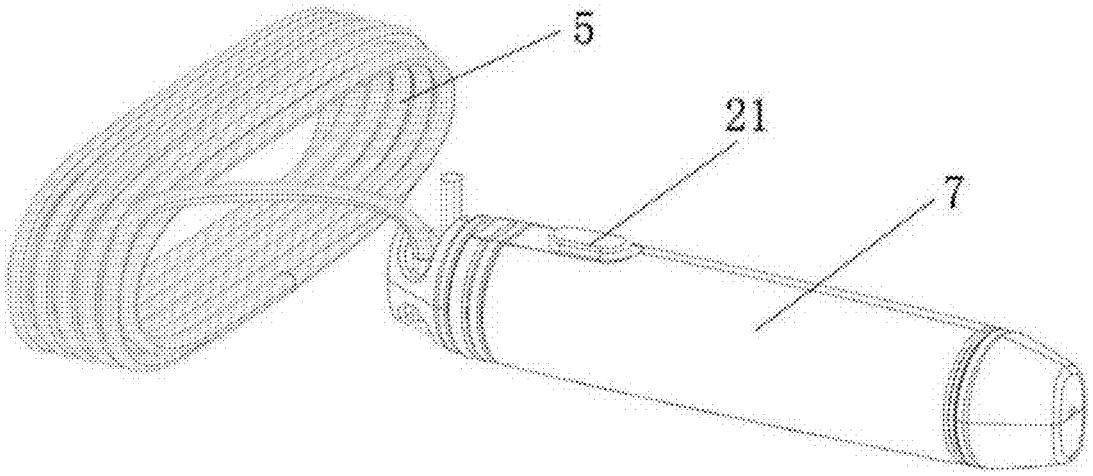
FIG. 9 is a schematic diagram of a handle after being connected with an end of a rope skipping equipment according to an embodiment of the present disclosure.
Figure 10:
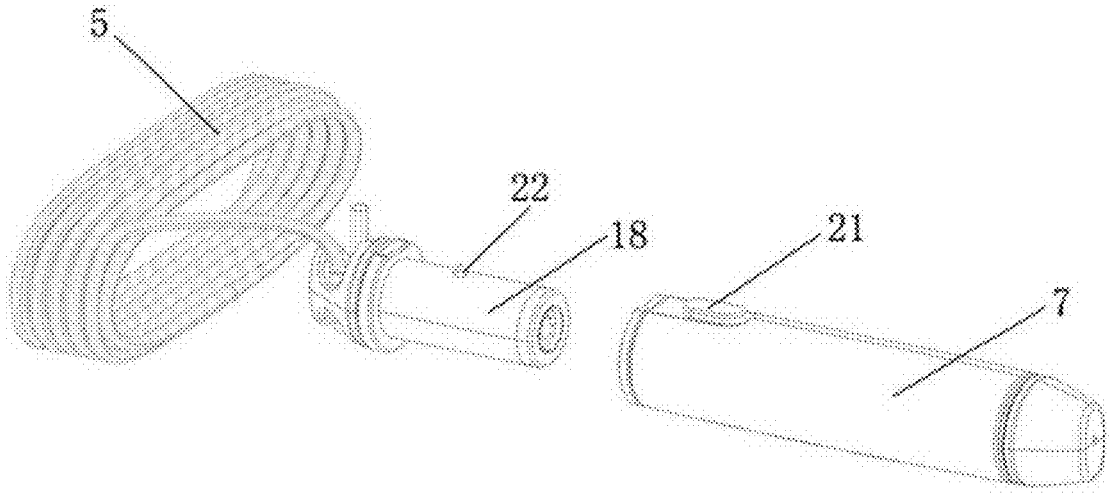
FIG. 10 is a schematic diagram of the handle after being withdrawn from the end of the rope skipping equipment according to an embodiment of the present disclosure.

As shown in FIGS. 9 and 10, an infrared detector is built in the rope skipping equipment 5, and third pin connectors 18 matched with the bayonet 15 of the handle 7 and provided with a signal line is disposed at two ends (only one end is shown in the figures) of the rope skipping equipment 5, respectively. The infrared detector is configured to detect the number of rope skips and a rope skipping direction of the user. When the third pin connector 18 are inserted into the bayonets 15 of the handles 7, the infrared detector can transmit the detected data to the processor 11 by means of the signal lines of the third pin connector 18.

Figure 11:
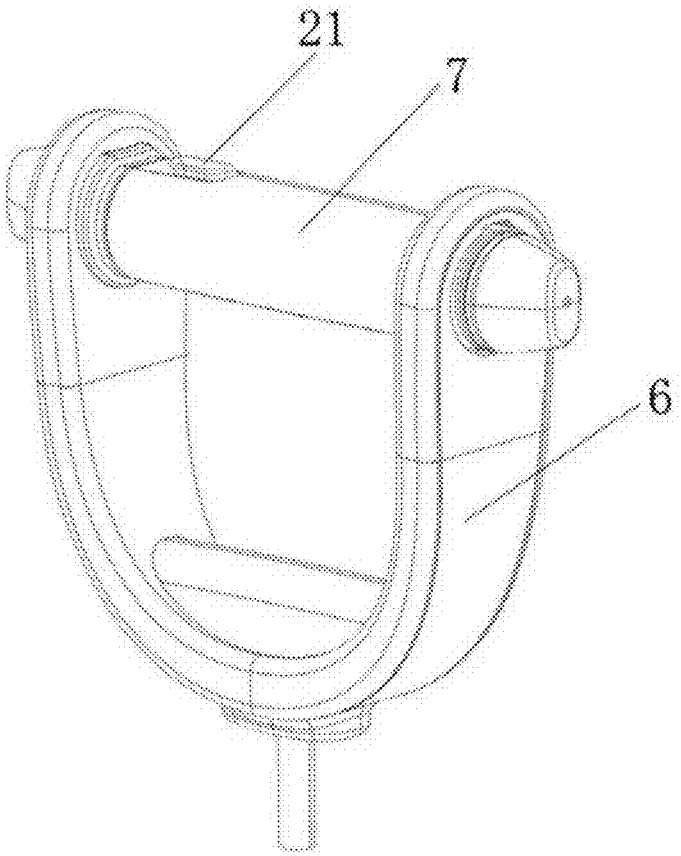
FIG. 11 is a schematic diagram of a handle after being connected with an end of an elastic rope equipment according to an embodiment of the present disclosure.
Figure 12:
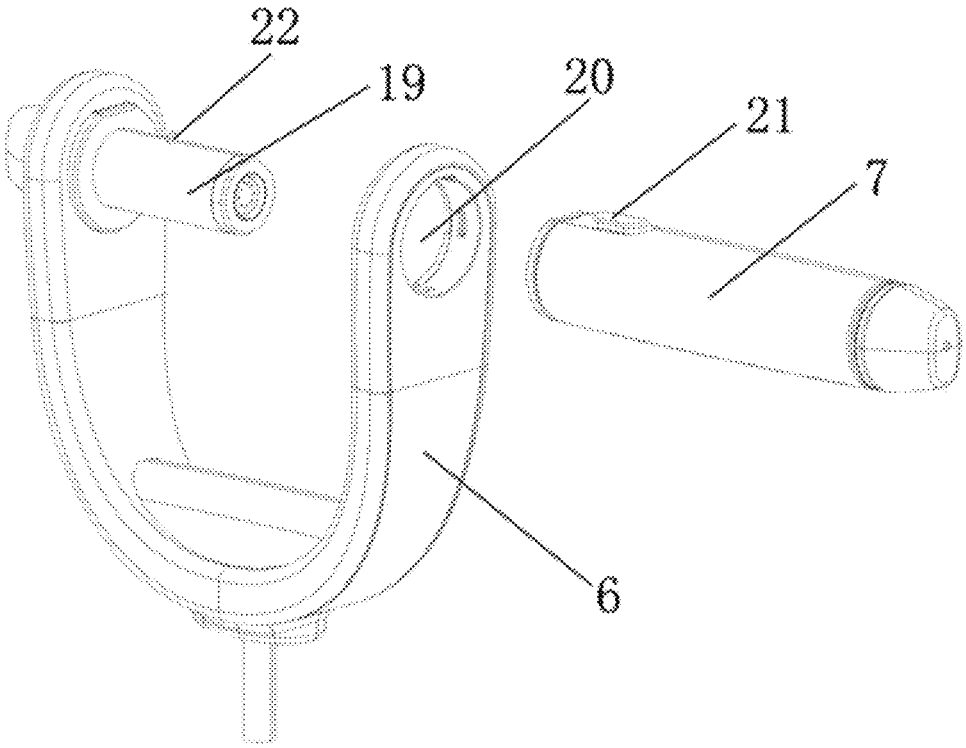
FIG. 12 is a schematic diagram of the handle after being withdrawn from the end of the elastic rope equipment according to an embodiment of the present disclosure.

As shown in FIGS. 11 and 12, the elastic rope equipment 6 has two ends, each of which is U-shaped, and a tension sensor is built in the elastic rope equipment 6. The figures illustrate that one end of the U-shaped part of one end is provided with a fourth pin connector 19 matched with the bayonet 15 of the handle 7 and that the U-shaped part is further provided with an opening 20 for the handle 7 to pass through, wherein the fourth pin connector 19 is provided with a signal line. The tension sensor is configured to detect user's tension data. When the fourth pin connector 19 is inserted into the bayonets 15 of the handles 7, the sensor can transmit the detected data to the processor 11 by means of the signal lines of the fourth pin connector 19.

As shown in FIGS. 3 to 12, an elastic button 21 is disposed on the handle 7. An elastic clamping piece 22 is disposed in a position, corresponding to the elastic button 21, on each of the first pin connectors 16, the second pin connectors 17, the third pin connectors 18 and the fourth pin connectors 19. The handle 7, after being connected to any handheld fitness equipment, is locked by the elastic clamping piece 22 on the corresponding pin connector of the handheld fitness equipment. When the elastic button 21 of the handle 7 is pressed down, the elastic clamping piece 22 on the corresponding pin connector of the handheld fitness equipment is pressed to move downwards, so that the handle 7 can depart from the handheld fitness equipment.

The working principle of this embodiment is as follows: when the handle 7 is connected with any handheld fitness equipment, the processor built in the handle 7 receives an equipment identification number transmitted by the handheld fitness equipment via the corresponding pin connector. Then, the processor 11 may start counting for the handheld fitness equipment, and collect movement information, such as a movement count, whether a movement action is correct, and the like, from the handheld fitness equipment according to the equipment identification number, and then upload the movement information to an application (App) of a mobile terminal, so that the mobile terminal can collect the movement information of the handheld fitness equipment in real time. When the handle is switched to next handheld fitness equipment, the handle may automatically identify the identification number thereof and upload it to the APP of the mobile terminal at the same time, thereby collecting different movement information.

As shown in FIGS. 1 to 12, the push-up equipment 4 has one portion that is detachably fixed on the upper portion of the support 1 by inserting the second pin connector 17 into the first hole 8, and other portion that is detachably fixed on the lower portion of the support 1 by inserting the second pin connector 17 into the second hole 9. The power roller equipment 3 is arranged between the two portions of the push-up equipment 4 and two ends of the power roller equipment 3 are inserted into the centers of the two portions of the push-up equipment 4 by means of the first pin connectors 16, respectively. The rope skipping equipment 5 is inserted into the third hole 10. A rope portion of the elastic rope equipment 6 is hung on the support 1 in such a manner that two ends of the elastic rope equipment 6 are located on the left and right sides of the support 1, respectively. The two handles 7 are placed on the base 2, and the support 1 is fixedly connected to the base 2.

Embodiment 2

This embodiment involves the following main features: when the handle 7 is connected to any handheld fitness equipment, the processor 11 built in the handle 7 receives an equipment identification number transmitted by the handheld fitness equipment via the corresponding pin connector. Then, the processor 11 may start counting for the handheld fitness equipment, and collect movement information, such as a movement count, whether a movement action is correct, and the like, from the handheld fitness equipment according to the equipment identification number, and then upload the movement information to a cloud server. The other the mobile terminal can collect the movement information of the handheld fitness equipment in real time. Other contents are the same with embodiment 1.

Embodiment 3

This embodiment involves the following main characteristics: a photoelectric sensor (for counting), a heart rate sensor, a distance measuring sensor, a pressure sensor and the like are further built in the handle 7, and such sensors are connected to the processor 11, respectively. Other contents are the same with embodiment 1.

Embodiment 4

This embodiment involves the following main characteristics: the intelligent fitness set may further comprise handheld fitness equipments such as kettlebells, dumbbells, power twisters, wrist exercising equipments and sit-up equipments. Other contents are the same with embodiment 1.

The mobile terminal mentioned in the above embodiments may be a smart phone, a PDA handheld terminal, a tablet computer, an electronic book, a man-machine interaction terminal or other handheld terminal equipment having a displaying function.

To sum up, the intelligent fitness handle of the present disclosure can be connected to a plurality of handheld fitness equipments with the design of a switchable hot-pluggable bayonet, and each handheld fitness equipment has corresponding sensors and pin connectors each matched with the bayonet of the handle. When the handle is connected with one of the plurality of handheld fitness equipments, the processor built in the handle receives the equipment identification number transmitted by the handheld fitness equipment via the corresponding pin connector and collects movement information from the corresponding handheld fitness equipment according to the equipment identification number. In the intelligent fitness set, the handle can be switched to the movement modes of different handheld fitness equipments to collect action feedbacks from different equipments. Thus, a plurality of handheld fitness equipments can share one handle to achieve the goals of simple structure, low cost, and accomplishing a set of exercises with a plurality of handheld fitness equipments by using one same set of handles.

The forgoing are merely descriptions of the preferred embodiments of the present disclosure to which, however, the scope of patent protection of the present disclosure is not restricted. Equivalent replacements or alterations made by those skilled in the art based on the technical solutions of the present disclosure and the disclosure concept thereof within the claimed scope of the present disclosure shall all fall into the scope of protection of the present disclosure.

What is claimed is:

1. A switchable intelligent fitness handle, wherein a processor, a movement posture sensor and a touch sensor are built in the handle;

the movement posture sensor and the touch sensor are connected respectively to the processor;

one end of the handle is closed; a bayonet is arranged at the other end of the handle;

the bayonet is switchable and hot-pluggable, configured to connect respectively to a plurality of handheld fitness equipments;

a pin connector matched with the bayonet is arranged in each of the plurality of handheld fitness equipments;

when the handle is connected to one of the plurality of handheld fitness equipments, the processor receives an equipment identification number transmitted by the handheld fitness equipment through the pin connector, collects movement information of the corresponding handheld fitness equipment based on the received equipment identification number, and uploads the movement information to a mobile terminal or a cloud server.

2. The switchable intelligent fitness handle according to claim 1, wherein an elastic button is arranged on the handle;

after the handle is connected to one of the plurality of handheld fitness equipments, the handle will be locked by an elastic clamping piece arranged on the pin connector corresponding to the elastic button; and when the elastic button on the handle is pressed, the elastic clamping piece on the pin connector is pressed to move downwards, enabling the handle to depart from each of the plurality of handheld fitness equipments.

3. The switchable intelligent fitness handle according to claim 1, wherein a power supply is further built in the handle and the power supply is configured to power the processor, the movement posture sensor and the touch sensor.

4. The switchable intelligent fitness handle according to claim 1, wherein a photoelectric sensor is further built in the handle, and the photoelectric sensor is connected to the processor.

5. The switchable intelligent fitness handle according to claim 1, wherein a heart rate sensor is further built in the handle, and the heart rate sensor is connected to the processor.

6. The switchable intelligent fitness handle according to claim 1, wherein a distance measuring sensor is further built in the handle, and the distance measuring sensor is connected to the processor.

7. The switchable intelligent fitness handle according to claim 1, wherein a pressure sensor is further built in the handle, and the pressure sensor is connected to the processor.

8. An intelligent fitness set comprising the handle of claim 1, further comprising: a support, a base, the plurality of handheld fitness equipments and two handles;

wherein a sensor, and the pin connector matched with the bayonet of the handle are arranged in each of the plurality of handheld fitness equipments;

a signal line is arranged in the pin connector;

the plurality of handheld fitness equipments are detachably fixed on the support;

the two handles are placed on the base; and the support is fixedly connected to the base.

9. The intelligent fitness set according to claim 8, wherein the plurality of handheld fitness equipments comprise: a power roller equipment, a push-up equipment, a rope skipping equipment, and a U-shaped elastic rope equipment;

a pressure sensor and an infrared ranging device are built in the handheld power roller equipment;

the pin connector matched with the bayonet of each of the handle is arranged at each of two ends of the handheld power roller equipment;

the pressure sensor, an infrared ranging device and an infrared line-crossing detection unit are built in the push-up equipment;

the pin connector matched with the bayonet of the handle is arranged on a top of the push-up equipment;

an infrared detector is built in the rope skipping equipment;

the pin connector matched with the bayonet of the handle is arranged at two ends of the rope skipping equipment;

a tension sensor is built in the elastic rope equipment;

the pin connector matched with the bayonet of the handle is arranged at one end of a U-shaped opening of the elastic rope equipment; and an opening is arranged at the other end of the U-shaped opening of the elastic rope equipment for the handle to pass through.

10. The intelligent fitness set according to claim 9, wherein a first hole is arranged in an upper portion of the support, and a second hole and a third hole are arranged in a lower portion of the support;

one portion of the push-up equipment is detachably fixed on the upper portion of the support by inserting the pin connector into the first hole;

the other portion is detachably fixed on the lower portion of the support by inserting the pin connector into the second hole;

the power roller equipment is arranged between the two portions of the push-up equipment;

two ends of the power roller equipment are inserted into the centers of the two portions of the push-up equipment through the pin connector;

the rope skipping equipment is inserted into the third hole;

the elastic rope equipment is hung on the support, such that the two ends of the elastic rope equipment are positioned on two sides of the support.

* * * * *